US009640378B2

(12) United States Patent
Hayashi

(10) Patent No.: US 9,640,378 B2
(45) Date of Patent: May 2, 2017

(54) TIME-OF-FLIGHT MASS SPECTROMETER

(71) Applicant: HAMAMATSU PHOTONICS K.K., Hamamatsu-shi, Shizuoka (JP)

(72) Inventor: Masahiro Hayashi, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 15/001,709

(22) Filed: Jan. 20, 2016

(65) Prior Publication Data

US 2016/0217995 A1 Jul. 28, 2016

(30) Foreign Application Priority Data

Jan. 23, 2015 (JP) ..... 2015-011087
Jan. 15, 2016 (JP) ..... 2016-005864

(51) Int. Cl.

*H01J 49/02* (2006.01)
*H01J 43/20* (2006.01)
*H01J 43/24* (2006.01)
*H01J 49/40* (2006.01)

(52) U.S. Cl.

CPC ..... *H01J 49/025* (2013.01); *H01J 43/20* (2013.01); *H01J 43/246* (2013.01); *H01J 49/40* (2013.01)

(58) Field of Classification Search

USPC ..... 250/287, 397
See application file for complete search history.

(56) References Cited

U.S. PATENT DOCUMENTS 4,568,853 A 2/1986 Boutot
7,564,043 B2 7/2009 Hayashi et al.
8,294,089 B2 10/2012 Suzuki et al.
2008/0230686 A1* 9/2008 Suzuki ..... H01J 49/025 250/281
2008/0290267 A1* 11/2008 Hayashi ..... H01J 43/246 250/282
2014/0097340 A1* 4/2014 Suzuki ..... G01T 1/00 250/287

FOREIGN PATENT DOCUMENTS

JP 5049174 B2 10/2012

* cited by examiner

*Primary Examiner* — Kiet T Nguyen
(74) *Attorney, Agent, or Firm* — Drinker Biddle & Reath LLP

(57) ABSTRACT

An embodiment of the invention relates to a TOF-MS capable of performing mass spectrometry of a sample at a high throughput. The TOF-MS has an acceleration part for accelerating an ion, a detector for detecting an event of arrival of the accelerated ion, and a data processing part for performing mass spectrometry of the sample, based on a time of flight of the ion. A first structure of the detector includes an MCP, a dynode, and an anode. In the first structure, the dynode is set at a potential higher than that of an output face of the MCP. The anode is disposed at an intermediate position between the MCP and the dynode or on the dynode side with respect to the intermediate position. The anode has plural apertures and is set at a potential higher than that of the dynode.

8 Claims, 10 Drawing Sheets

TIME-OF-FLIGHT MASS SPECTROMETER

TECHNICAL FIELD

The present invention relates to a time-of-flight mass spectrometer (hereinafter referred to as "TOF-MS").

BACKGROUND

TOF-MS is a device that can perform mass spectrometry of a sample, based on a time of flight of an ion generated from the sample and accelerated by an electric field, to arrival of the ion at a detector, for example, as described in Japanese Patent No. 5049174 (Patent Literature 1).

TOF-MS is expanding its scope of applications, e.g., not only life science fields but also industrial materials and foods, because of discovery of a method of directly ionizing macromolecules such as proteins. TOF-MS has the greatest feature of enabling high-sensitivity measurement and can determine a composition of a sample even in very small, amount of femtomole order by analysis based on chemical quantities of masses. Since all ions generated from the sample impinge upon the detector, TOF-MS can perform a cyclopedic analysis of molecules from small molecules to macromolecules.

In TOF-MS, an ion is made to fly by using an ionization probe such as laser light and orthogonal acceleration or the like as trigger and the ion is made to reach the detector located at a position distant by a given distance from the ion source. When the ion arrives at the detector, the detector outputs an electric pulse signal. Since the flight velocity of the ion after accelerated by the electric filed depends on a mass-to-charge ratio of the ion, the mass spectrometry of the sample can be performed based on a time of flight to arrival at the detector (or to the time of output of the pulse signal).

As an output signal from the detector, pulse heights according to the numbers of respective ions (counts) are recorded as waveform data by an oscilloscope or the like. Using an arithmetic device such as a personal computer, times of flight can be converted into mass-to-charge ratios, based on the recorded waveform data, and the mass-to-charge ratios and pulse height outputs are placed to create a mass spectrum. From this mass spectrum, an abundance ratio of molecular species in the sample as an analysis target is obtained as qualitative and quantitative information.

SUMMARY

The inventors conducted detailed research on the conventional TOF-MSs and found the problem as described below. Specifically, in the case of the conventional TOF-MSs, it is important for the detector to detect events of arrival of ions at the detector with high sensitivity. Most of the conventional TOF-MSs use the detector including a Micro-Channel Plate (hereinafter referred to as "MCP"). Since MCP has the larger effective diameter and faster response characteristic than the other secondary electron multipliers, it is used as a detector in analysis equipment necessitating the subnanosecond time resolution, such as time-of-flight measurement, as well as TOF-MS.

With improvement in performance of electronic components and ionization technology, TOF-MS is also required in recent years to achieve a higher throughput for a high-speed analysis of a large amount of sample, in addition to the hitherto cyclopedic analysis of substances included in a small amount of sample. As a result, a great burden is imposed on the detector and the detector performance is becoming a bottle neck, to achievement of a higher throughput. The throughputs of the conventional TOF-MSs including the device described in the foregoing first Patent Literature are insufficient and there are desires for achievement of a much higher throughput.

The present invention has been accomplished in order to solve the above-described problem and it is an object of the present invention to provide a trine-of-flight mass spectrometer (TOF-MS) capable of performing the mass spectrometry of the sample at a high throughput.

A TOF-MS (time-of-flight mass spectrometer) according to an embodiment of the invention has an acceleration part (analyzer), a detector, and a data processing part. The acceleration part accelerates an ion generated from a sample, by an electric field. The detector is disposed on a flight path of the accelerated ion after passage through the acceleration part and detects an event of arrival of the ion. The data processing part performs mass spectrometry of the sample, based on a time of flight of the ion to a time of detection of the event by the detector. Particularly, the detector has a first structure comprised of an MCP (micro-channel plate) for multiplying electrons generated in accordance with incidence of the ion generated from the sample, a dynode, and an anode, or, a second structure comprised of an MCP, an anode, and an electrode.

In the detector having the first structure, the MCP has an input face located at a position of the arrival of the ion, and an output face opposing the input face. This output face outputs the multiplied electrons. The dynode multiplies the electrons outputted from the output face of the MCP. The dynode is disposed on the opposite side to the input face of the MCP with respect to the output face of the MCP. The dynode is set at a potential higher than a potential of the output face of the MCP. The anode is disposed in a space from the dynode to an intermediate position between the output face of the MCP and the dynode, in order to collect the electrons multiplied by the dynode. The anode has an aperture for letting the electrons outputted from the output face of the MCP, pass toward the dynode. Furthermore, the anode is set at a potential higher than the potential of the dynode.

On the other hand, in the detector having the second structure, the MCP has an input face located at a position of the arrival of the ion, and an output face opposing the input face. This output face outputs the multiplied electrons. The anode is disposed on the opposite side to the input face of the MCP with respect to the output face of the MCP, in order to collect the electrons outputted from the output face of the MCP. The anode is set at a potential higher than a potential of the output face of the MCP. The electrode in the second structure is disposed in a space from the anode to an intermediate position between the output face of the MCP and the anode. This electrode has an aperture for letting the electrons outputted from the output face of the MCP, pass toward the anode. Furthermore, this electrode is set at a potential higher than the potential of the anode.

Each of embodiments according to the present invention will become more fully understood from the detailed description given hereinbelow and the accompanying drawings. These examples are presented by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, and it is apparent that various modifications and improvements within the scope of the invention would be obvious to those skilled in the art from this detailed description.

DETAILED DESCRIPTION

[Description of Embodiment of Invention]

Figure 1:
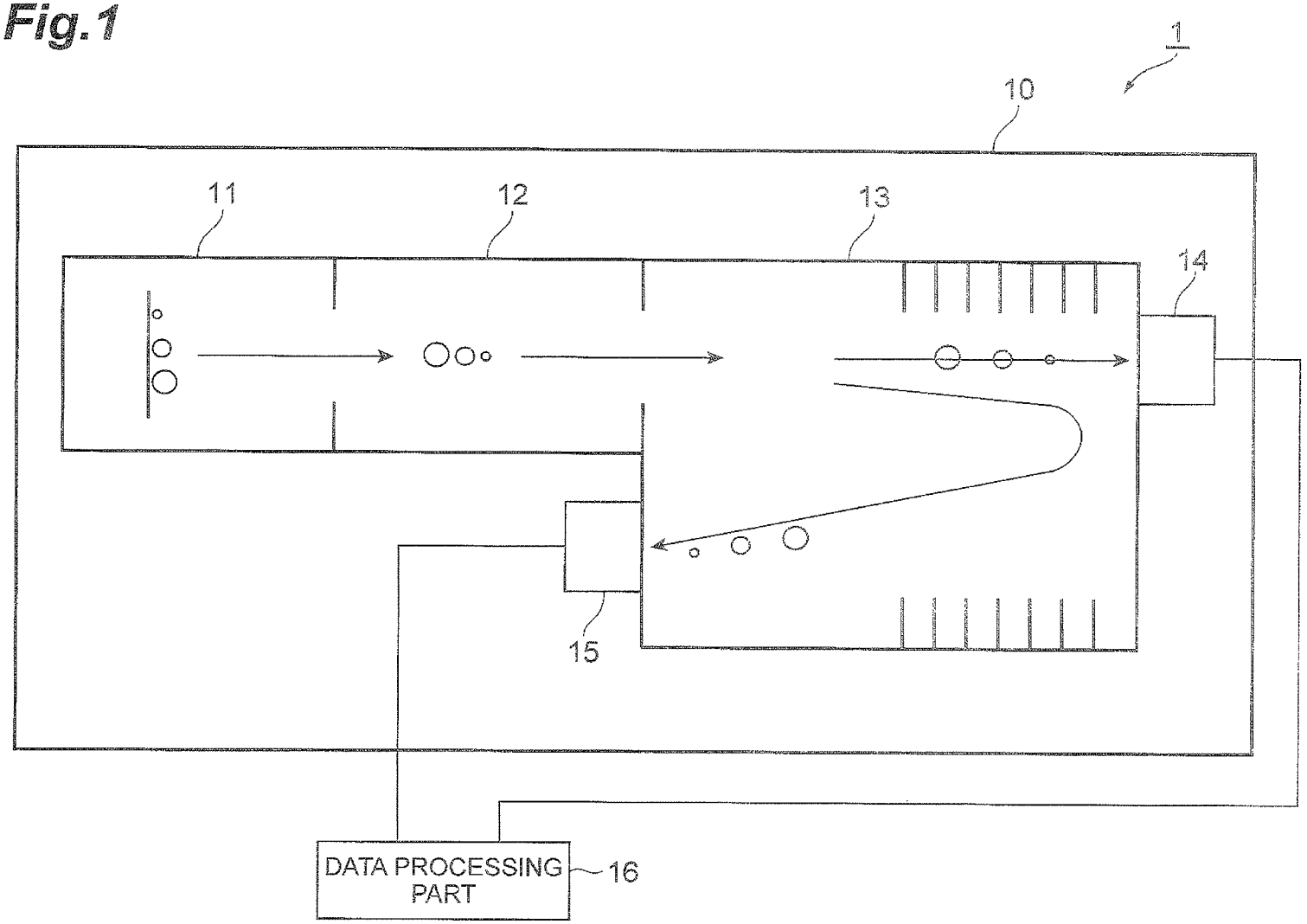
FIG. 1 is a drawing showing a schematic configuration of the TOF-MS (time-of-flight mass spectrometer) according to the first embodiment.

First, the contents of the embodiment of the invention will be described each as individually enumerated below.

(1) A TOF-MS (time-of-flight mass spectrometer) according to the embodiment of the invention, as an aspect thereof, has an acceleration part (analyzer), a detector, and a data processing part. The acceleration part accelerates an ion generated from a sample, by an electric field. The detector is disposed on a flight path of the accelerated ion after passage through the acceleration part and detects an event of arrival of the ion. The data processing part performs mass spectrometry of the sample, based on a time of flight of the ion to a time of detection of the event by the detector. Particularly, the detector has a first structure comprised of an MCP (micro-channel plate) for multiplying electrons generated in accordance with incidence of the ion generated from the sample, a dynode, and an anode, or, a second structure comprised of an MCP, an anode, and an electrode.

In the detector having the first structure, the MCP has an input face located at a position of the arrival of the ion, and an output face opposing the input face. This output face outputs the multiplied electrons. The dynode multiplies the electrons outputted from the output face of the MCP. The dynode is disposed on the opposite side to the input face of the MCP with respect to the output face of the MCP. The dynode is set at a potential higher than a potential of the output face of the MCP. The anode is disposed in a space from the dynode to an intermediate position between the output face of the MCP and the dynode, in order to collect the electrons multiplied by the dynode. The anode has an aperture for letting the electrons outputted from the output face of the MCP, pass toward the dynode. Furthermore, the anode is set at a potential higher than the potential of the dynode.

On the other hand, in the detector having the second structure, the MCP has an input face located at a position of the arrival of the ion, and an output face opposing the input face. This output face outputs the multiplied electrons. The anode is disposed on the opposite side to the input face of the MCP with respect to the output face of the MCP, in order to collect the electrons outputted from the output face of the MCP. The anode is set at a potential higher than a potential of the output face of the MCP. The electrode in the second structure is disposed in a space from the anode to an intermediate position between the output face of the MCP and the anode. This electrode has an aperture for letting the electrons outputted from the output face of the MCP, pass toward the anode. Furthermore, this electrode is set at a potential higher than the potential of the anode.

(2) in the detector having the first structure, as one aspect of the embodiment, an aperture rate of the anode is preferably not more than 90%. As one aspect of the embodiment, the anode preferably has a plurality of apertures arranged two-dimensionally. Furthermore, as one aspect of the embodiment, the dynode is preferably comprised of a metal flat plate coated with a film to increase a secondary electron emission efficiency.

(3) On the other hand, in the detector having the second structure, as one aspect of the embodiment, an aperture rate of the electrode disposed between the MCP and the anode is preferably not more than 90%. As one aspect of the embodiment, this electrode preferably has a plurality of apertures arranged two-dimensionally. Furthermore, the anode is preferably comprised of a metal flat plate, Each of the aspects enumerated in this [Description of Embodiment of Invention] above is applicable to each of all the remaining aspects or to all combinations of these remaining aspects.

Details of Embodiment of Invention

Specific examples of the TOF-MS according to the present invention will be described below in detail with reference to the accompanying drawings. It should be noted that the present invention is by no means intended to be limited to the below-described examples presented by way of illustration but is intended for inclusion of all changes within the meaning and scope of equivalence to the scope of claims, as described in the scope of claims. The same elements will be denoted by the same reference signs in the description of the drawings, without redundant description.

First described is how we have accomplished the present invention. The MCP used as a detector in the TOF-MS is a secondary electron multiplier having a structure with a plurality of micro-channels arranged two-dimensionally and independently of each other. The MCP has an output face set at a higher potential than an input face whereby it can multiply electrons. Specifically, when a charged particle collides with an inner wall face of each channel, secondary electrons are emitted therefrom and the electrons are accelerated by a potential gradient to collide with the inner wall face of the channel. This process is repeated in each channel, whereby a large number of multiplied electrons are outputted from the output face.

The electron multiplication function of MCP is restricted when the inner wall of each channel is saturated with charge.

For restraining this charge saturation, it is effective to supply electrons by strip current flowing in the channel wall. There was the conventional attempt to increase the strip current by reduction in resistance of the MCP. Expansion of the linear range (linearity) of extracted charge by reduction in resistance of the MCP is an effective means. On the other hand, however, the MCP resistance has a negative temperature coefficient and the MCP is used in a high vacuum where radiation of heat is difficult; for this reason, generation of heat by the strip current in the MCP itself can cause warming and discharge phenomena. Since the MCP detector used in the existing TOF-MSs is implemented with full resistance reduction measures, it is practically difficult to further reduce the resistance.

In the high-sensitivity measurement being the greatest feature of the TOF-MS, the multiplication rate (gain) of about $10^5$ to $10^6$ is needed for converting an ion with only the elementary charge of monovalence into an electric pulse signal by the detector. The gain is essential to achievement of high S/N. In measuring a large amount of sample within a fixed time by achievement of a higher throughput, the TOF-MS subjected to increase in amount of ions generated substantially can measure molecule ions in the low mass region whose time of flight is short, at high S/N but can measure molecule ions in the high mass region whose time of flight is long, at low S/N if the upper limit of linearity of the MCP is exceeded. Namely, because of the upper limit of linearity determined by the MCP resistance, the maximum amount of incident ions and the gain have a trade-off relation expressed by Expression (1) below, $$\text{(Upper limit of linearity of MCP)}=\text{(maximum amount of incident ions)}\times\text{(gain)} \quad (1)$$

The present invention provides the TOF-MS capable of performing the mass spectrometry of the sample at a high throughput, based on the Inventors' research as described above, and, particularly, is characterized by the configuration of the detector. Embodiments of the TOF-MS of the present invention will be described below.

First Embodiment

FIG. 1 is a drawing showing a schematic configuration of the TOF-MS (time-of-flight mass spectrometer) 1 according to the first embodiment. The TOF-MS 1 has a housing 10 constituting a vacuum vessel, and a data processing part 16. The housing 10 is composed of three vacuum chambers 11 to 13 and the last vacuum chamber 13 is equipped with detectors 14, 15.

A sample as an analysis target is set in the first vacuum chamber 11 and the sample is irradiated with pulsed laser light to generate ions. A mass filter and transfer ion optics or the like are disposed in the second vacuum chamber 12 and act as an acceleration part for accelerating the ions generated from the sample, by an electric field.

A pair of slits is located between the second vacuum chamber 12 and the third vacuum chamber 13. The ions flying from the first vacuum chamber 11 into the second vacuum chamber 12 are subjected to such selection by the mass filter as to select ions with masses over a certain mass, and the ions thus selected are accelerated by the electric field. The accelerated ions fly via the transfer ion optics and the pair of slits into the third vacuum chamber 13.

The ions flying into the third vacuum chamber 13 can reach the detector (linear detector) 14. Alternatively, the ions flying into the third vacuum chamber 13 can also reach the detector (reflectron detector) 15 while their flying path is bent by action of an electrostatic ion mirror disposed in the third vacuum chamber 13.

The detectors 14, 15 are disposed on the flight paths of the accelerated ions after passage through the acceleration part and are configured to detect events of arrival of the ions and output respective electric pulse signals. The data processing part 16 performs mass spectrometry of the sample, based on times of flight of the ions to times of detection of the ion arrival events at the detector 14 or at the detector 15.

Figure 2:
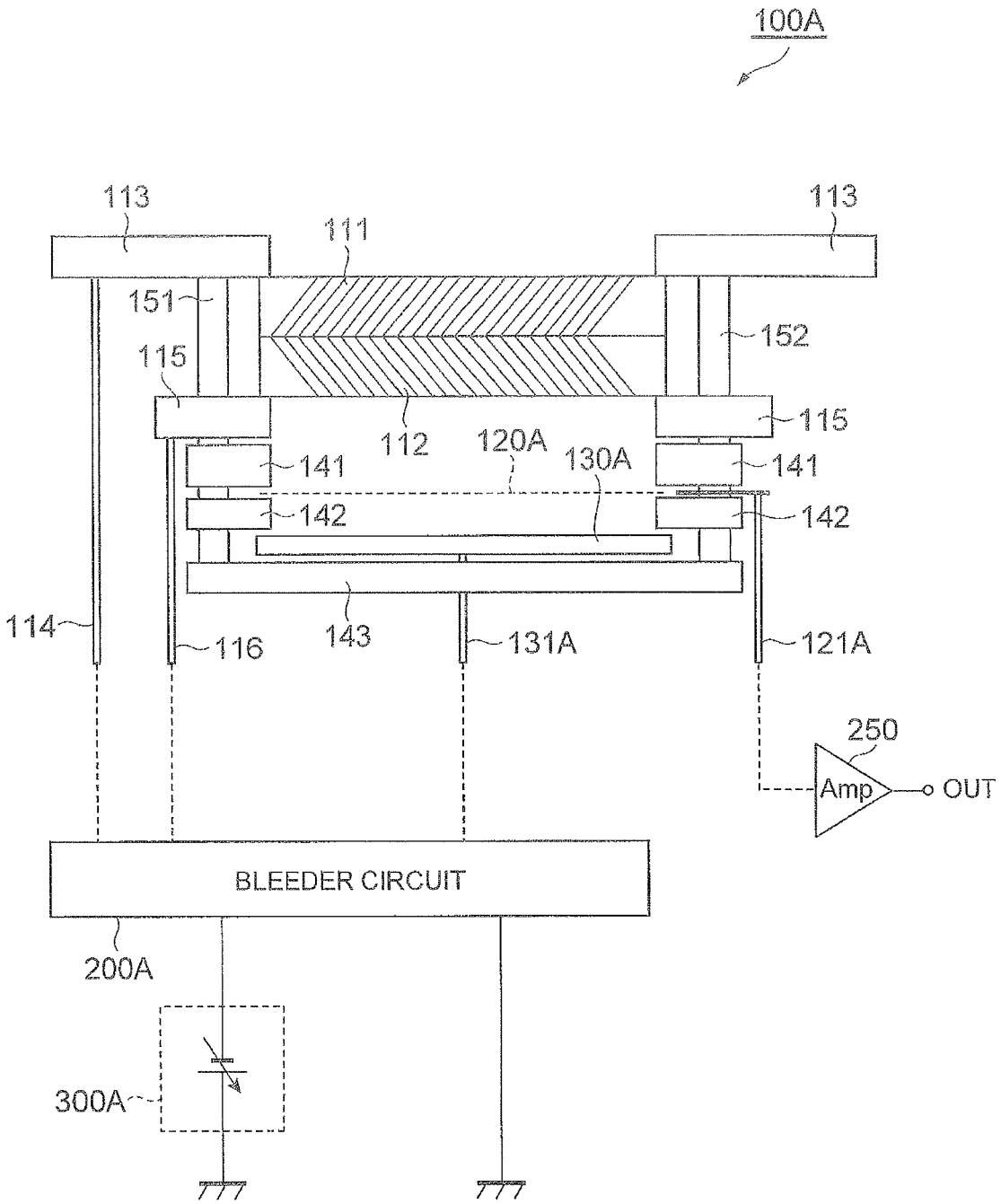
FIG. 2 is a drawing showing a cross-sectional structure of the detector having the first structure.
Figure 3A:
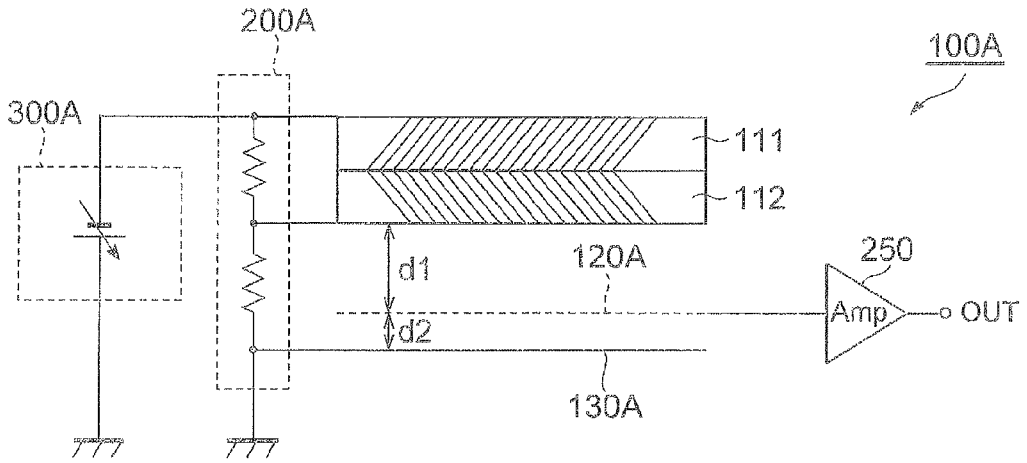
FIGS. 3A and 3B are drawings showing a specific structure for setting electrodes in the detector (first structure) shown in FIG. 2, at respective predetermined potentials and a potential setting state at each of the electrodes.

FIGS. 2 and 3A are drawings showing a configuration of a detector 100A applicable to the TOF-MS shown in FIG. 1. This detector 100A is applicable to the detectors 14, 15 in FIG. 1. The detector 100A includes, as a first structure, a laminate consisting of MCP 111 and MCP 112 (hereinafter referred to as "MCP laminate"), an anode 120A, a dynode 130A, and a bleeder circuit 200A connected to an external power supply 300A. The bleeder circuit 200A applies predetermined voltages to respective electrodes, for forming a potential gradient as in the example shown in FIG. 3B.

In the detector 100A having this first structure, each of the MCPs 111, 112 is a secondary electron multiplier having the structure with a plurality of micro-channels arranged two-dimensionally and independently of each other. Each channel has the inner diameter of about 10 μm and is inclined at about 10° relative to a normal direction (coincident with a direction of incidence of ions) to an input face of the MCP laminate (hereinafter referred to as "MCP input face"). It is noted, however, that the inclination direction of each channel in the MCP 111 is different from that in the MCP 112. A lead wire 114 extending from the bleeder circuit 200A is connected through an in electrode (hereinafter referred to as "MCP-IN electrode") 113 to the MCP input face. Similarly, a lead wire 116 extending from the bleeder circuit 200A is connected through an out electrode (hereinafter referred to as "MCP-OUT electrode") 115 to an output face of the MCP laminate (hereinafter referred to as "MCP output face"). Namely, the bleeder circuit 200A applies the predetermined voltages to the respective MCP-IN electrode 113 and MCP-OUT electrode 115 through the lead wires 114, 116, whereby the MCP input face and the MCP output face are set at the respective predetermined potentials. The output face is set at the potential higher than that of the input face, whereby the MCP laminate multiplies electrons generated in accordance with arrival of ions at the input face and outputs the multiplied electrons from the output face.

The dynode 130A is disposed on the side where the MCP output face lies (or on the opposite side to the MCP input face with respect to the MCP output face) and is configured to multiply the electrons outputted from the MCP output face. The bleeder circuit 200A is connected through a lead wire 131A to the dynode 130A and, the bleeder circuit 200A applies the predetermined voltage to the dynode 130A whereby the dynode 130A is set at the potential higher than that of the MCP output face. The dynode 130A is a metal flat plate (e.g., a SUS flat plate) arranged in parallel to the MCP output face. The dynode 130A is preferably configured so that a surface of the metal flat plate (the face facing the MCP output face) is coated with a high-δ film (a film with a high secondary electron emission efficiency). The high-δ film is, for example, an alkali metal film, which is preferably an $MgF_2$ film.

The anode 120A is disposed in parallel to the MCP output face, in a space from the dynode 130A to an intermediate position between the MCP output face and the dynode 130A. The anode 120A may be located, at the intermediate position between the MCP output face and the dynode 130A. The anode 120A has an aperture for letting the electrons outputted from the MCP output face, pass toward the dynode 130A. The anode 120A is connected to a lead wire 121A and the electric pulse signal outputted from the anode 120A is amplified by an amplifier (Amp) 250. The anode 120A is set at the potential higher than that of the dynode 130A and is configured to collect the electrons multiplied by the dynode 130A. An aperture rate of the anode 120A is preferably not more than 90%. Furthermore, the anode 120A is preferably configured in a mesh shape with a plurality of apertures arranged two-dimensionally.

The anode 120A is sandwiched between a ceramic plate 141 and a ceramic plate 142. The dynode 130A is sandwiched between the ceramic plate 142 and a ceramic plate 143. Each of the MCP-IN electrode 113, MCP-OUT electrode 115, and ceramic plates 141-143 has an annular shape. A relative positional relationship among the MCP-IN electrode 113, MCP-OUT electrode 115, and ceramic plates 141-143 is fixed with screws 151, 152, thereby assembling the detector 100A having the first structure.

In this detector 100A, the anode 120A and dynode 130A are arranged in order along the direction from the MCP input face to the MCP output face. The bleeder circuit 200A applies the predetermined voltages to these respective electrodes through the lead wires 114, 116, 121A (the GND potential in the example in FIGS. 2, 3A, and 3B), and 131A so that the potential of the dynode 130A is higher than the potential of the MCP output face and so that the potential of the anode 120 A is higher than the potential of the dynode 130A. When an ion arrives at the MCP input face, electrons generated in response to the arrival of the ion are multiplied in the MCPs 111, 112. A large number of electrons thus multiplied are outputted from the MCP output face. Most of the large number of electrons outputted from the MCP output face pass through the aperture of the anode 120A to collide with the dynode 130A and this collision causes the dynode 130A to generate a larger number of electrons. The anode 120A collects the larger number of electrons generated by the dynode 130A. Namely, when ions arrive at the MCP input face, the anode 120A outputs the electric pulse signal having a crest value depending on the number of ions.

Figure 3B:
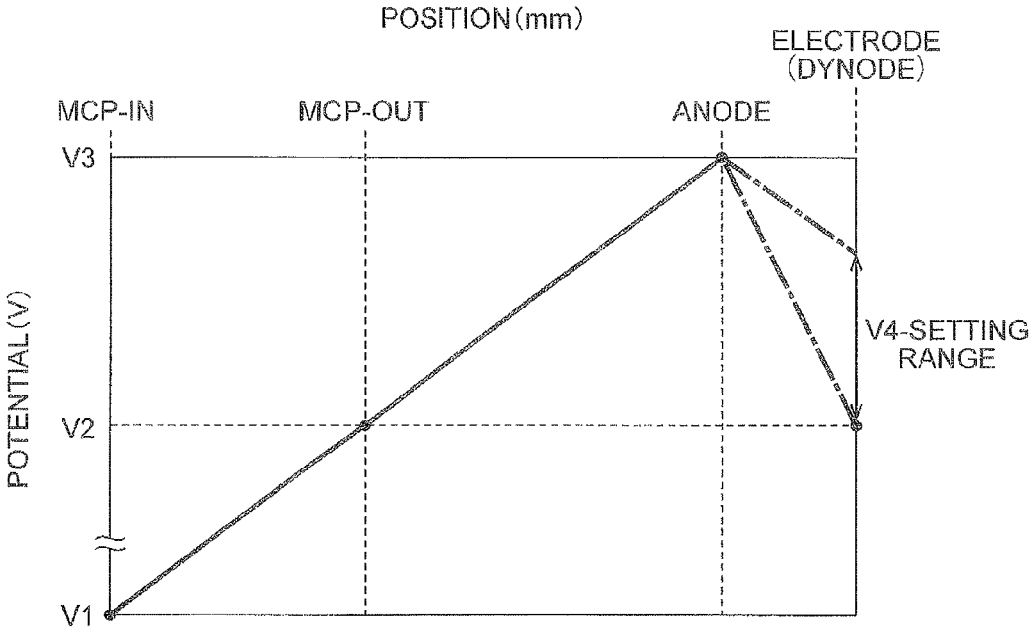

In an example of the potential gradient shown in FIG. 3B, the potential V1 of the MCP input face (MCP-IN electrode 113) is set at −2500V, the potential V2 of the MCP output face (MCP-OUT electrode 115) is set at −500V, the potential V3 of the anode 120A is set at 0V (GNU potential), and the potential V4 of the dynode 130A is set at a negative potential in the range (V4-setting range) of from V2 to V3. Regarding the potential gradient from MCP-IN electrode 113 to the anode 120A, the potential V1 of the MCP-IN electrode 113 may be set at 0V (GNU potential). In this case, as an example, the potential V1 of the MCP-IN electrode 113 is set at 0V (GNU potential), the potential V2 of the MCP-OUT electrode 115 is set at +2000V, the potential V3 of the anode 120A is set at +2500V, and the potential V4 of the dynode 130A is set at a positive potential in the range (V4-setting range) of from V2 to V3. Also, in the configuration in which the anode 120A is set at a positive potential, a condenser is disposed between the anode 120A and the amplifier 250 to keep a signal output level at the GND level).

Figure 4:
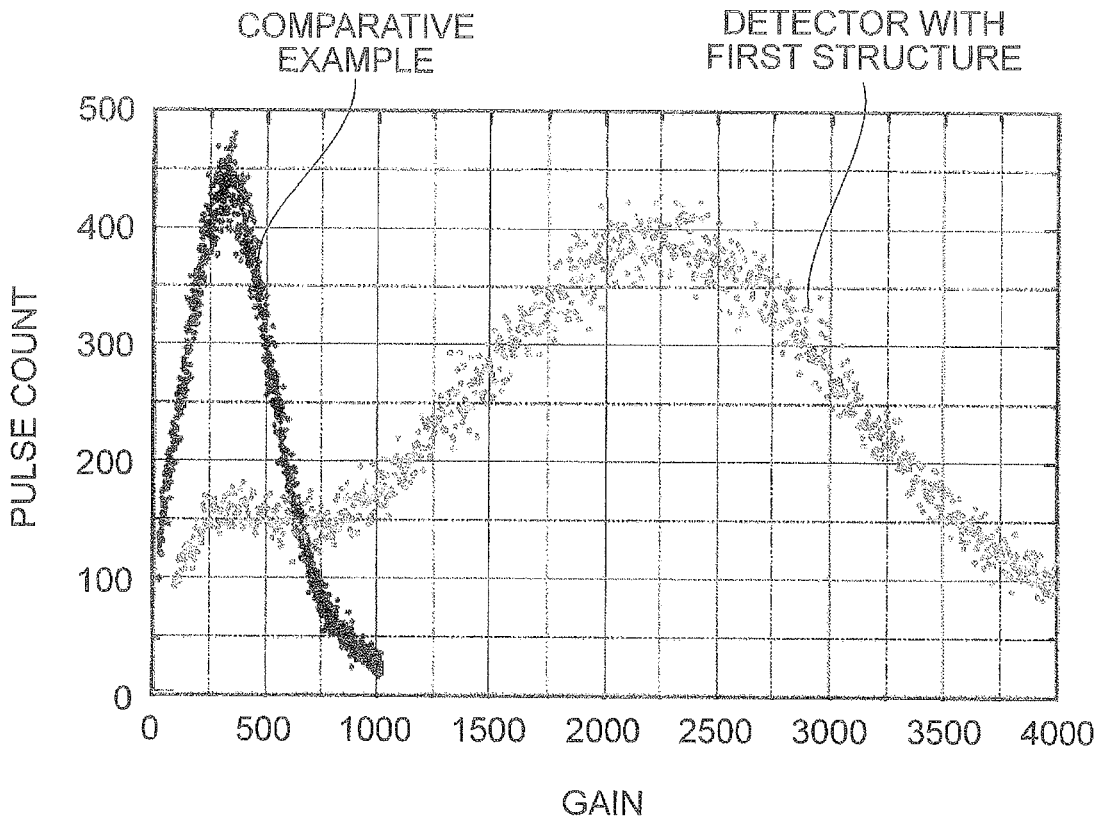
FIG. 4 is a graph showing a gain characteristic of the detector (first structure) shown in FIG. 2.

FIG. 4 is a graph showing a gain characteristic of the detector 100A. The horizontal axis represents the gain and the vertical axis the pulse count of electrons outputted from the MCP output face. In both of the detector 100A with the first structure and a comparative example, the distance between the MCP output face and the anode 120A was 1 mm and the distance between the anode 120A and the dynode 130A 1 mm. The dynode 130A was a SUS plate coated with an $MgF_2$ film. The potential V1 of the MCP input face was −2500V, the potential V2 of the MCP output face −500V, and the potential V3 of the anode 120A 0V (GNP potential). In the comparative example, the potential V4 of the dynode 130A was set at 0V (GND potential) and the anode 120A and dynode 130A were bundled so as to detect all the electrons outputted from the MCP. In the detector 100A applied to the present embodiment, electrons were detected by the anode 120A while the potential V4 of the dynode 130A was set at −250V.

As can be seen from FIG. 4, the gain of the detector 100A was approximately 6.3 times the gain of the comparative example. A sub-peak is recognized at the position of the gain peak of the comparative example in the gain characteristic of the detector 100A, and this indicates that some of the large number of electrons outputted from the MCP output face are directly captured by the anode 120A without reaching the dynode 130A. In the description hereinbelow, a ratio of the gain of the detector 100A (where the potential V3 of the anode 120A is set higher than the potential V4 of the dynode 130A) to the gain of the comparative example (where the anode 120A and dynode 130A are bundled so as to set the anode 120A and dynode 130A at the same potential) will be referred to as "relative gain."

Figure 5:
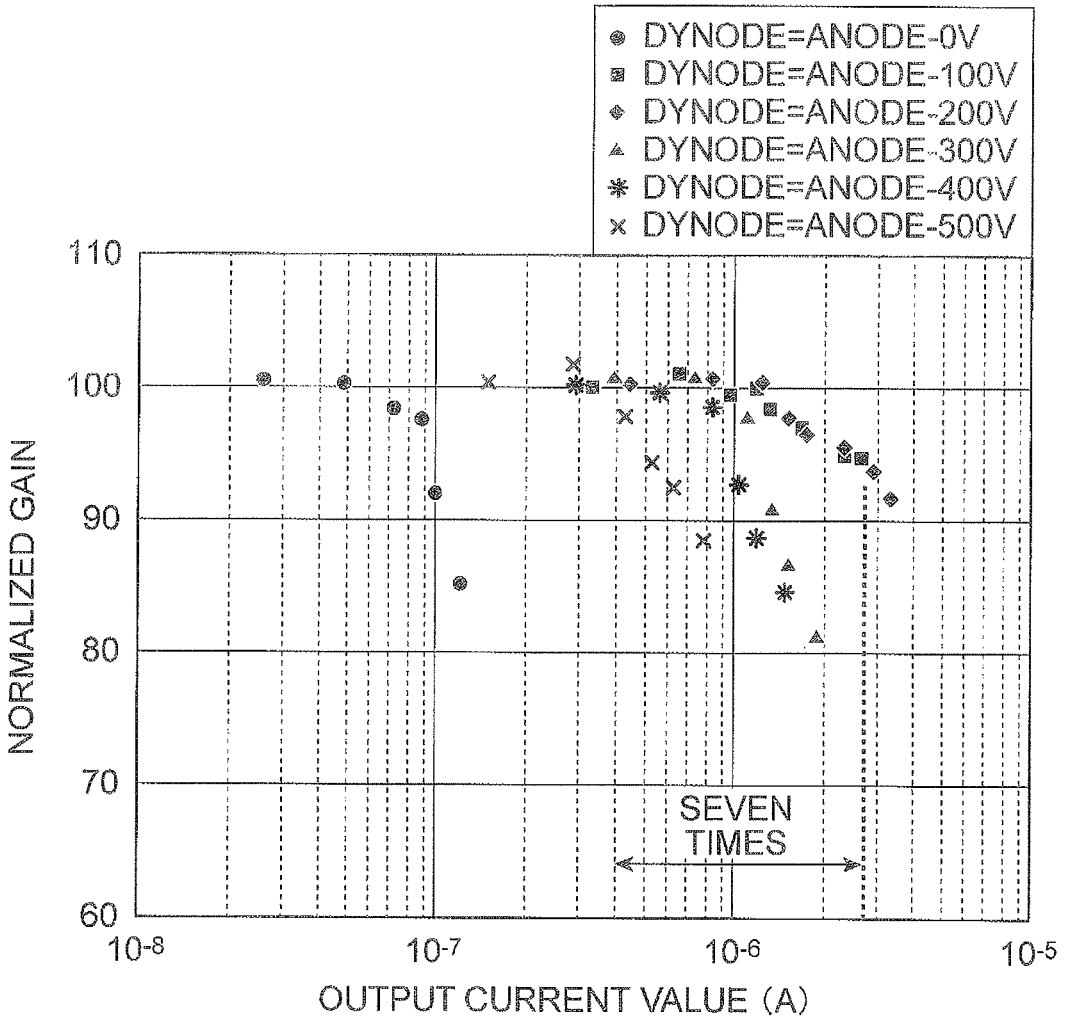
FIG. 5 is a graph showing linearity characteristics of the detector (first structure) shown in FIG. 2.

FIG. 5 is a graph showing linearity characteristics of the detector 100A. The horizontal axis represents the output current value (A) from the anode 120A and the vertical axis the normalized gain. The normalized gain is defined as 100 for the gain at small output current values. In FIG. 5, mark "●" indicates the linearity characteristic with the potential V4 of the dynode 130A set at the same potential as the potential V3 of the anode 120A, mark "■" the linearity characteristic with the potential V4 of the dynode 130A set at −100V with respect to the potential V3 of the anode 120A, mark "◆" the linearity characteristic with the potential V4 of the dynode 130A set at −200V with respect to the potential V3 of the anode 120A, mark "▲" the linearity characteristic with the potential V4 of the dynode 130A set at −300V with respect to the potential V3 of the anode 120A, combined mark of "*" and "-" the linearity characteristic with the potential V4 of the dynode 130A set at −400V with respect to the potential V3 of the anode 120A, and mark "x" the linearity characteristic with the potential V4 of the dynode 130A set at −500V with respect to the potential V3 of the anode 120A. In both of the detector 100A and the comparative example used in this measurement, the distance between the MCP output face and the anode 120A was 1 mm and the distance between the anode 120A and the dynode 130A 1 mm. The dynode 130A was a SUS plate coated with an $MgF_2$ film. The potential V1 of the MCP input face was set at −2500V, the potential V2 of the MCP output face at −500V, and the potential V3 of the anode 120A at 0V (GND potential). In the comparative example, the potential V4 of the dynode 130A was set at 0V and the dynode 130A and anode 120A were bundled. As can be seen from FIG. 5, the DC linearity of the detector 100A with the potential V4 of the dynode 130A set at −200V with respect to the potential V3 of the anode 120A, was expanded to approximately seven times that of the comparative example.

It is understood from FIGS. 4 and. 5 that in the detector 100A applied to the present embodiment the linearity is also expanded by the degree of multiplication of the gain with respect to the comparative example.

Figure 6A:
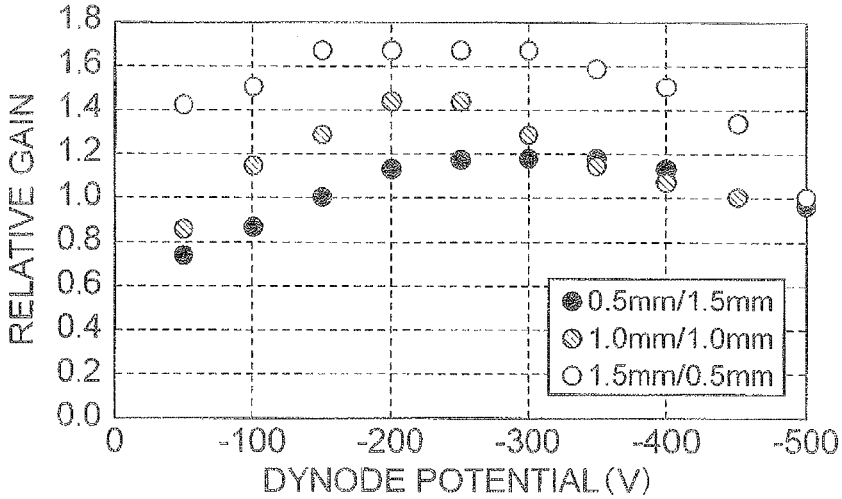
FIGS. 6A to 6C are graphs showing relations between dynode potential and relative gain, which were measured with variation in aperture rate of the anode, in the detector (first structure) shown in FIG. 2.
Figure 6B:
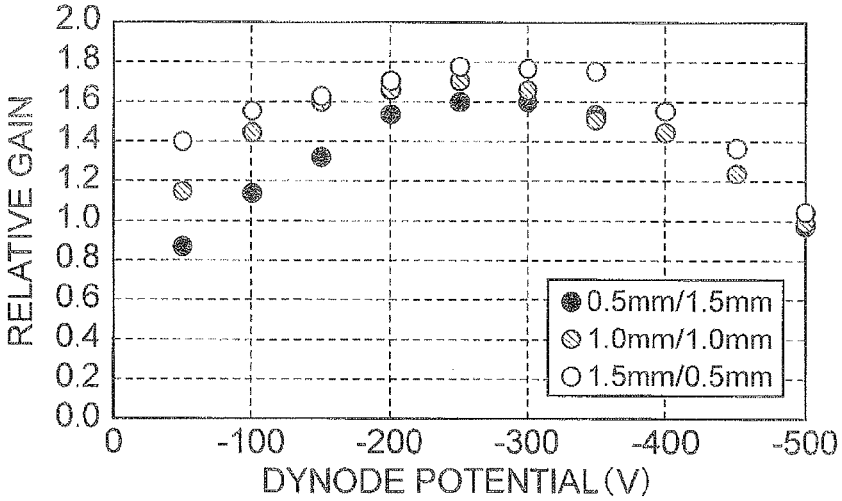
Figure 6C:
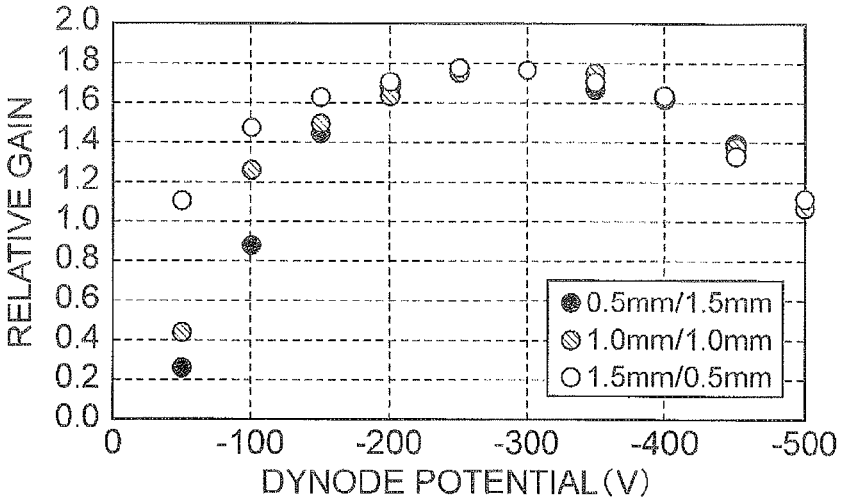

FIGS. 6A to 6C are graphs showing relations between dynode potential V4 and relative gain of the detector 100A, which were measured with variation in aperture rate of the anode 120A. FIG. 6A shows the relation obtained with the aperture rate of the anode 120A of 81%. FIG. 6B shows the relation obtained with the aperture rate of the anode 120A of 90%. FIG. 6C shows the relation obtained with the aperture rate of the anode 120A of 96%. In the detector 100A used in this measurement, the dynode 130A was a SUS plate not coated with the high-δ film. The potential V1 of the MCP input face was −-2500V, the potential V2 of the MCP output face −500V, and the potential V3 of the anode 120A 0V (GND potential). The varying potential range of the dynode 130A was from −50V to −500V. Each of FIGS. 6A to 6C shows measured values obtained in each of configuration wherein the distance between the MCP output face and dynode 130A is 2.0 mm and wherein the ratio d1/D2 of the distance d1 between the MCP output face and the anode 120A to the distance d2 between the anode 120A and the dynode 130A is 0.5 mm/1.5 mm, 1.0 mm/1.0, mm, or 1.5 mm/0.5 mm.

As can be seen from these FIGS. 6A to 6C, the relative gain is greater in the case of the distance d2 being 1.0 mm than in the case of the distance d2 being 1.5 mm between the anode 120A and the dynode 130A and the relative gain is much greater in the case of the distance d2 being 0.5 mm. Therefore, the anode 120A is preferably located in the space from the dynode 130A to the intermediate position between the MCP output face and the dynode 130A (or the anode 120A may be located at the intermediate position between the MCP output face and the dynode 130A) because the relative gain can be kept large. The difference in relative gain becomes more prominent as the potential difference between the anode 120A and the dynode 130A becomes smaller or as the aperture rate of the anode 120A becomes smaller. Therefore, the aperture rate of the anode 120A is preferably not more than 90%.

Figure 7:
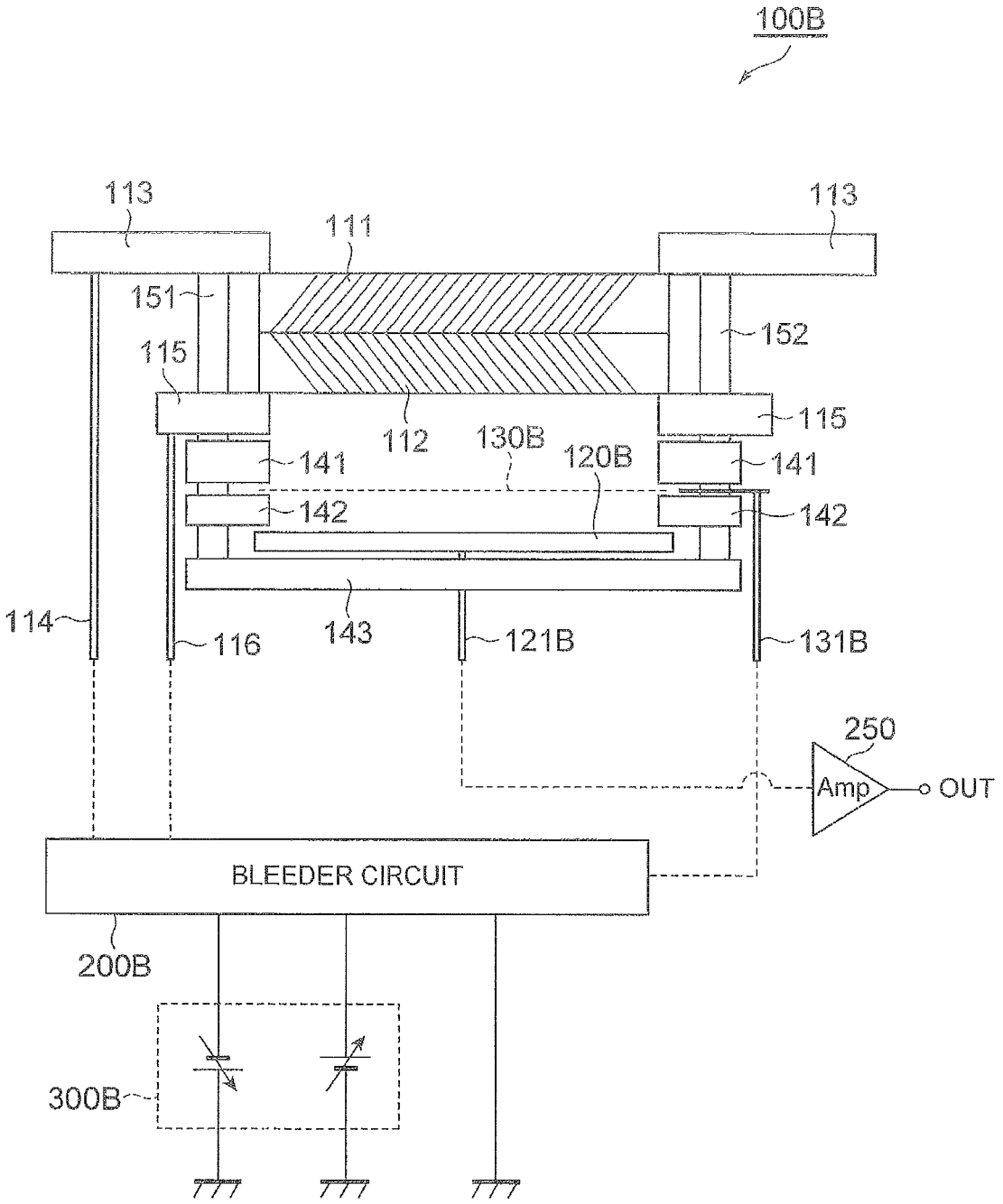
FIG. 7 is a drawing showing a cross-sectional structure of the detector having the second structure.
Figure 8A:
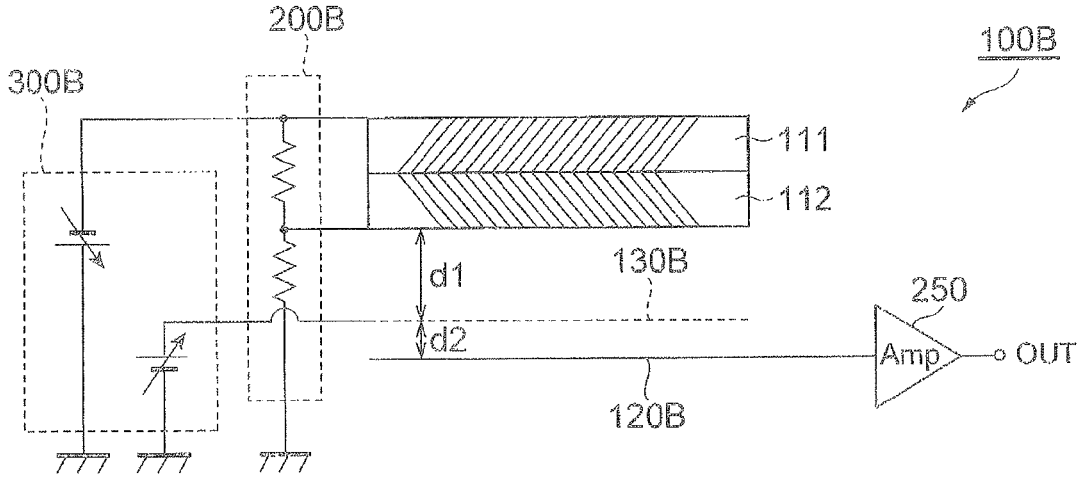
FIGS. 8A and 8B are drawings showing a specific structure for setting electrodes in the detector (second structure) shown in FIG. 7, at respective predetermined potentials and a potential setting state at each of the electrodes.

Next, the detector 100B with the second structure, which is applicable to the TOF-MS 1 in FIG. 1, will be described with reference to FIGS. 7, 8A-8B, and 9. FIGS. 7 and 8A are drawings showing the configuration of the detector 100B applicable to the detectors 14, 15 of the TOF-MS 1 in FIG. 1. This detector 100B includes, as the second structure, the MCP laminate consisting of the MCP 111 and MCP 112, an anode 120B, an electrode 130B, and a bleeder circuit 200B connected to an external power supply 300B. The bleeder circuit 200B applies predetermined voltages to the respective electrodes, for forming a potential gradient as in the example shown in FIG. 8B.

In the detector 100B having this second structure each of the MCPs 111, 112 is a secondary electron multiplier having the structure with a plurality of micro-channels arranged two-dimensionally and independently of each other. Each channel has the inner diameter of about 10 μm and is inclined at about 10° relative to the normal direction to the MCP input face. It is noted, however, that the inclination direction of each channel in the MCP 111 is different from that in the MCP 112. The lead wire 114 extending from the bleeder circuit 200B is connected through the MCP-IN electrode 113 to the MCP input face. Similarly, the lead wire 116 extending from the bleeder circuit 200B is connected through the MCP-OUT electrode 115 to the MCP output face. Namely, the bleeder circuit 200B applies the predetermined voltages to the respective MCP-IN electrode 113 and MCP-OUT electrode 115 through the lead wires 114, 116, whereby the MCP input face and the MCP output face are set at the respective predetermined potentials. The output face is set at the potential higher than that of the input face, whereby the MCP laminate multiplies electrons generated in accordance with arrival of ions at the input face and outputs the multiplied electrons from the output face.

The anode 120B is disposed on the side where the MCP output face lies (or on the opposite side to the MCP input face with respect to the MCP output face). The bleeder circuit 200B is connected through a lead wire 121B to the anode 120B and, the bleeder circuit 200B applies the predetermined voltage to the anode 120B whereby the anode 120B is set at the potential higher than that of the MCP output face. The anode 120B is a metal flat plate (e.g., a SUS flat plate) arranged in parallel to the MCP output face and is set at the potential higher than that of the MCP output face so as to collect the electrons outputted from the MCP output face. The electric pulse signal outputted from the anode 120B is amplified by the amplifier (Amp) 250.

The electrode 130B is disposed in parallel to the MCP output face, in a space from the anode 120B to an intermediate position between the MCP output face and the anode 120B. The electrode 130B may be located at the intermediate position between the MCP output face and the anode 120B. The electrode 130B has an aperture for letting the electrons outputted from the MCP output face, pass toward the anode 120B. The electrode 130B is connected to a lead wire 131E and the electrode 130B is set at the potential higher than that of the anode 120B. An aperture rate of the electrode 130 is preferably not more than 90%. Furthermore, the electrode 130B is preferably configured in a mesh shape with a plurality of apertures arranged two-dimensionally.

The electrode 130B is sandwiched between the ceramic plate 141 and the ceramic plate 142. The anode 120B is sandwiched between the ceramic plate 142 and the ceramic plate 143. Each of the MCP-IN electrode 113, MCP-OUT electrode 115, and ceramic plates 141-143 has an annular shape. The relative positional relationship among the MCP-IN electrode 113, MCP-OUT electrode 115, and ceramic plates 141-143 is fixed with the screws 151, 152, thereby assembling the detector 100B having the second structure.

In this detector 100B, the electrode 130B and anode 120B are arranged in order along the direction from the MCP input face to the MCP output face. The bleeder circuit 200B applies the predetermined voltages to these respective electrodes through the lead wires 114, 116, 121B (the GND potential in the example in FIGS. 7, 8A, and 8B), and 131B (a positive potential in the example in FIGS. 7, 8A, and 8B) so that the potential of the anode 120B is higher than the potential of the MCP output face and so that the potential of the electrode 130B is higher than the potential of the anode 120B. When an ion arrives at the MCP input face, electrons generated in response to the arrival of the ion are multiplied in the MCPs 111, 112. A large number of electrons thus multiplied are outputted from the MCP output face and accelerated toward the anode 120B by the electrode 130B. As a result, most of the large number of electrons outputted from the MCP output face pass through the aperture of the electrode 130B to be collected by the anode 120B. Namely, when ions arrive at the MCP input face, the anode 120B outputs the electric pulse signal having a crest value depending on the number of ions.

Figure 8B:
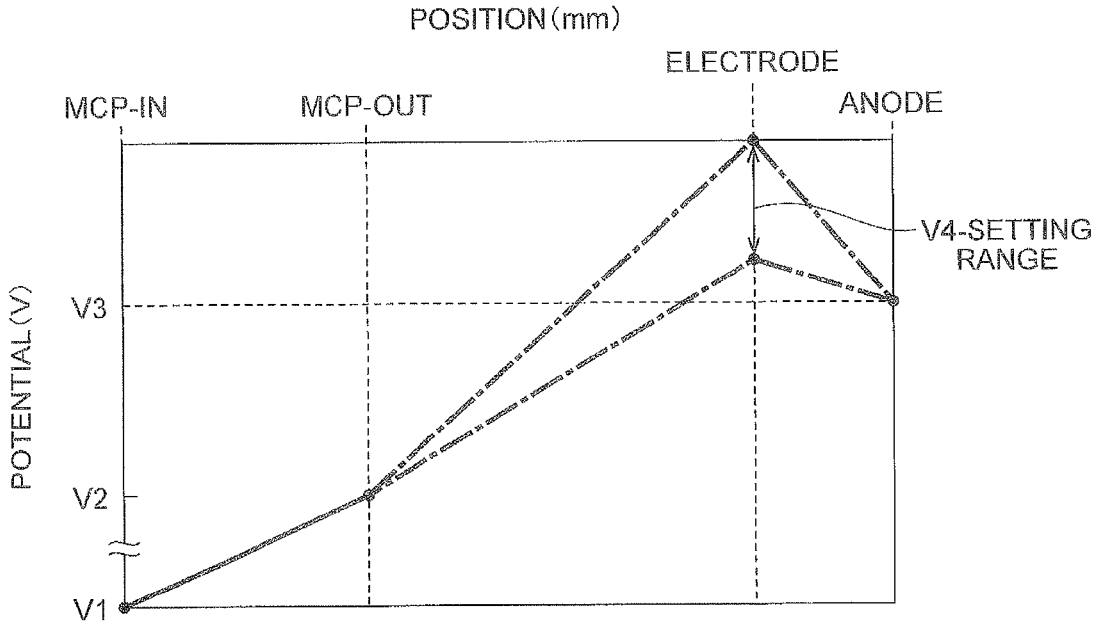

In an example of the potential gradient shown in FIG. 8B, the potential V1 of the MCP input face (MCP-IN electrode 113) is set at −2300V, the potential V2 of the MCP output face (MCP-OUT electrode 115) is set at −500V, the potential V3 of the anode 120B is set at 0V (GND potential), and the potential V4 of the electrode 130B is set at a positive potential (for, example +500V) in the range (V4-setting range) exceeding the V2. Regarding the potential gradient from MCP-IN electrode 113 to the anode 120B, the potential V1 of the MCP-IN electrode 113 may be set at 0V (GND potential). In this case, as an example, the potential V1 of the MCP-IN electrode 113 is set at 0V (GND potential), the potential V2 of the MCP-OUT electrode 115 is set at +500V, the potential V3 of the anode 120B is set at +2000V, and the potential V4 of the dynode 130B is set at a positive potential (for example, +2500V) in the range (V4-setting range) exceeding the V3. Also, in the configuration in which the anode 120B is set at a positive potential, a condenser is disposed between the anode 120B and the amplifier 250 to keep a signal output level at the GND level).

Figure 9:
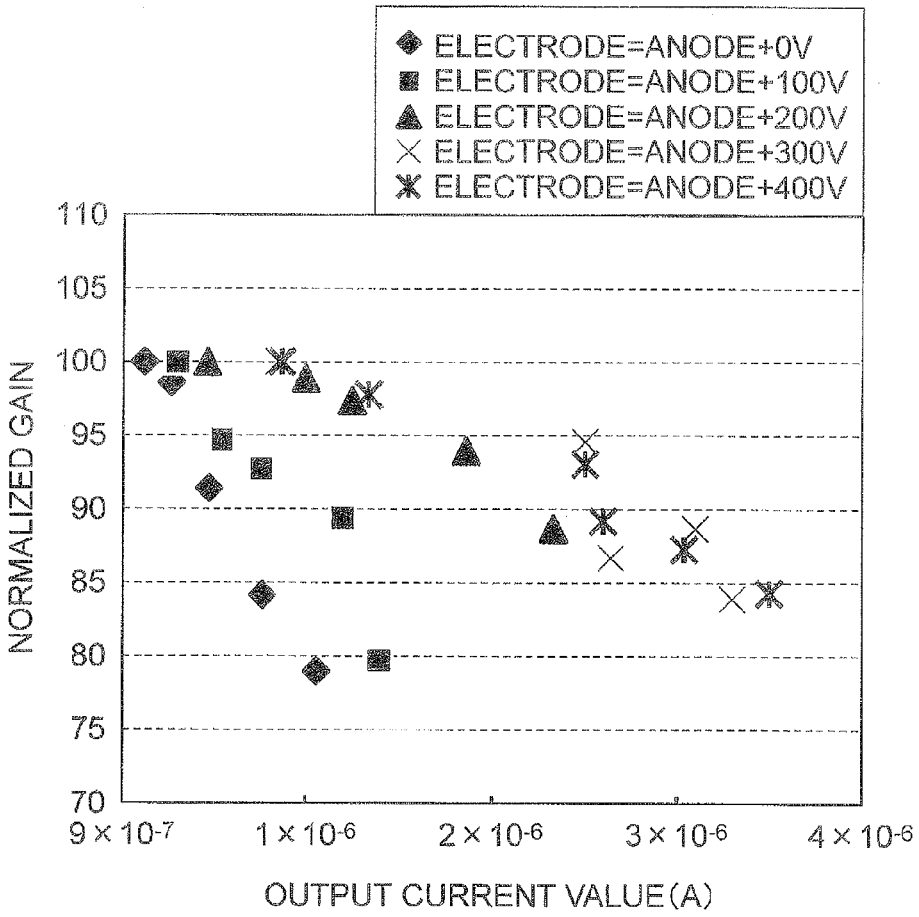
FIG. 9 is a graph showing linearity characteristics of the detector (second structure) shown in FIG. 7.

FIG. 9 is a graph showing linearity characteristics of the detector 100B. The horizontal axis represents the output current value (A) from the anode 120B and the vertical axis the normalized gain. The normalized gain is defined as 100 for the gain at small output current values. In FIG. 9, mark "◆" indicates the linearity characteristic with the potential V4 of the dynode 130B set at the same potential as the potential V3 of the anode 120B, mark "■" the linearity characteristic with the potential V4 of the electrode 130B set at +100V with respect to the potential V3 of the anode 120B, mark "▲" the linearity characteristic with the potential V4 of the electrode 130B set at +200V with respect to the potential V3 of the anode 120B, mark "x" the linearity characteristic with the potential V4 of the electrode 130B set at +300V with respect to the potential V3 of the anode 120B, mark "*" the linearity characteristic with the potential V4 of the electrode 130B set at +400V with respect to the potential V3 of the anode 120B. In the detector 100B used in this measurement, the distance between the MCP output face and the electrode 130B was 1 mm and the distance between the electrode 130B and the anode 120B 1 mm. The anode 120B was a SUS plate. The potential V1 of the MCP input face was set at −2300V, the potential V2 of the MCP output face at 500V, and the potential of the anode 120B at 0V (GND potential). As can be seen from FIG. 9, the detector 100B with the second structure also expanded the DC linearity by keeping the potential difference between the electrode 130B and anode 120B, for example, not less than 200V. It is understood that the linearity is also expanded by the degree of multiplication of the gain in the detector 100B applied to the present embodiment, compared to the comparative example of FIG. 5.

The detector 100A or the detector 100B with the structure as described above is applied to the detectors 14, 15 of the TOF-MS 1 of the first embodiment. Therefore, even with increase in amount of incident ions to the detector 100A or the detector 100B, the gain of the entire detector can be kept large while restraining increase in gain of the MCPs 111, 112. Therefore, the TOF-MS 1 can perform the mass spectrometry of the sample at a high throughput. Since each of the detector 100A and detector 100B can keep the gain of the MCPs 111, 112 low, the voltage applied between the input face and output face of the MCP laminate can be set low, which improves life characteristics. The detector 100A has a configuration in which the anode 120A is inserted between the MCP laminate and the dynode 130A, and the detector 100B has a configuration in which the electrode 130B is inserted between the MCP laminate and the anode 120B. Therefore, these can suppress increase in scale, compared to the conventional configurations.

Second Embodiment

Figure 10:
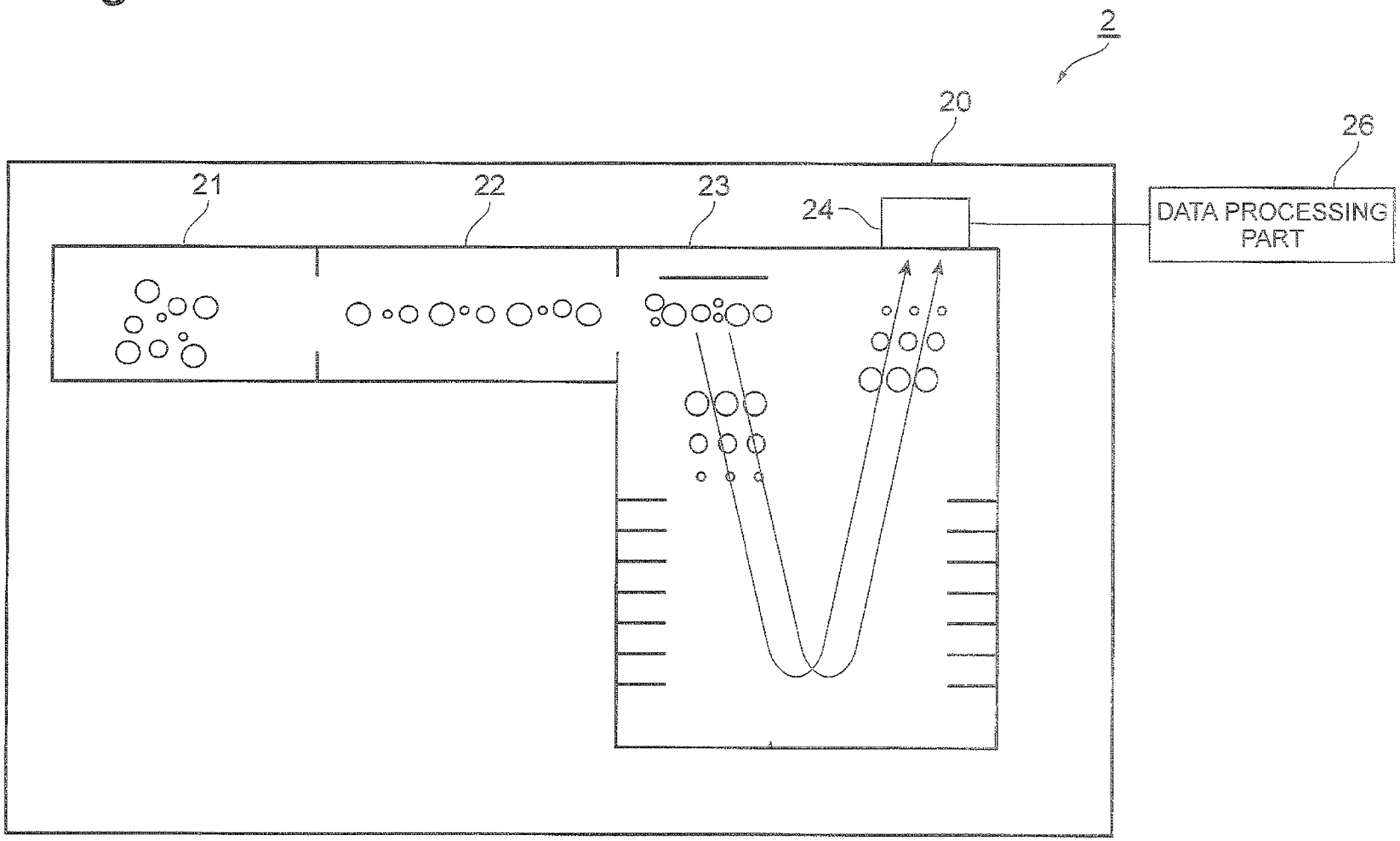
FIG. 10 is a drawing showing a schematic configuration of the TOF-MS (time-of-flight mass spectrometer) according to the second embodiment.

FIG. 10 is a drawing showing a schematic configuration of the TOF-MS (time-of-flight mass spectrometer) 2 according to the second embodiment. The TOF-MS 2 has a housing 20 constituting a vacuum vessel, and a data processing part 26. The housing 20 is composed of three vacuum chambers 21 to 23 and the last vacuum chamber 23 is equipped with a detector 24. Either of the detector 100A with the first structure (FIGS. 2 and 3A) and the detector 100B with the second structure (FIGS. 7 and 8A) as described above can be applied to this TOF-MS 2 of the second embodiment.

The sample as an analysis target is placed in the first vacuum chamber 21 and the sample is irradiated with laser light to generate ions. The laser light may be continuous light. A mass filter and transfer ion optics or the like are disposed in the second vacuum chamber 22.

A pair of slits is located between the second vacuum chamber 22 and the third vacuum chamber 23. The ions flying from the first vacuum chamber 21 into the second vacuum chamber 22 are subjected to such selection by the mass filter as to select those with masses over a certain mass, and the ions thus selected are accelerated by an electric field. The accelerated ions fly via the transfer ion optics and the pair of slits into the third vacuum chamber 23.

The ions flying into the third vacuum chamber 23 are accelerated in a direction perpendicular to the hitherto flying direction, by action of an ion pulser disposed in the third vacuum chamber 23. Subsequently, the accelerated ions are subjected to action of an electrostatic ion mirror disposed in the third vacuum chamber 23 so as to bend their flying direction and, thereafter, the ions reach the detector (reflectron detector) 24. The ion pulser acts as an acceleration part (analyzer) for accelerating the ions generated from the sample, by an electric field.

The detector 24 is disposed on the flight path of the accelerated ions after passage through the acceleration part and is configured to detect events of arrival of the ions (to output an electric pulsed signal from the anode). The data processing part 26 performs mass spectrometry of the sample, based on times of flight of the ions to times of detection of the ion arrival events at the detector 24.

The detector 100A with the first structure or the detector 100B with the second structure as described above is applied to the detector 24 of the TOF-MS 2 of the second embodiment. The TOF-MS 2 of the second embodiment achieves the same effect as the TOF-MS 1 of the first embodiment.

As described above, the TOF-MS according to the embodiment of the invention can perform the mass spectrometry of the sample at a high throughput.

From the above description of the present invention, it will be obvious that the present invention may be varied in many ways. Such variations are not to be regarded as a departure from the spirit and scope of the present invention, and all improvements as would be obvious to those skilled in the art are intended for inclusion within the scope of the following claims.

What is claimed is:

1. A time-of-flight mass spectrometer comprising:

an acceleration part for accelerating an ion generated from a sample, by an electric field;

a detector disposed on a flight path of the accelerated ion after passage through the acceleration part, and configured to detect an event of arrival of the ion; and a data processing part for performing mass spectrometry of the sample, based on a time of flight of the ion to a time of detection of the event by the detector, wherein the detector includes:

a micro-channel plate for multiplying electrons generated in accordance with the arrival of the ion, the micro-channel plate having an input face located at a position of the arrival of the ion, and an output face opposing the input face and outputting the multiplied electrons;

a dynode disposed on the opposite side to the input face with respect to the output face and configured to multiply the electrons outputted from the output face, the dynode being set at a potential higher than a potential of the output face; and an anode disposed in a space from the dynode to an intermediate position between the output face and the dynode and configured to collect the electrons multiplied by the dynode, the anode having an aperture for letting the electrons outputted from the output face, pass toward the dynode, the anode being set at a potential higher than the potential of the dynode.

2. The time-of-flight mass spectrometer according to claim 1, wherein an aperture rate of the anode is not more than 90%.

3. The time-of-flight mass spectrometer according to claim 1, wherein the anode has a plurality of apertures arranged two-dimensionally.

4. The time-of-flight mass spectrometer according to claim 1, wherein the dynode is comprised of a metal flat plate coated with a film to increase a secondary electron emission efficiency.

5. A time-of-flight mass spectrometer comprising:

an acceleration part for accelerating an ion generated from a sample, by an electric field;

a detector disposed on a flight path of the accelerated ion after passage through the acceleration part, and configured to detect an event of arrival of the ion; and a data processing part for performing mass spectrometry of the sample, based on a time of flight of the ion to a time of detection of the event by the detector, wherein the detector includes:

a micro-channel plate for multiplying electrons generated in accordance with the arrival of the ion, the micro-channel plate having an input face located at a position of the arrival of the ion, and an output face opposing the input face and outputting the multiplied electrons;

an anode disposed on the opposite side to the input face with respect to the output face and configured to collect the electrons outputted from the output face, the anode being set at a potential higher than a potential of the output face; and an electrode disposed in a space from the anode to an intermediate position between the output face and the anode, the electrode having an aperture for letting the electrons outputted from the output face, pass toward the anode, the electrode being set at a potential higher than the potential of the anode.

6. The time-of-flight mass spectrometer according to claim 5, wherein an aperture rate of the electrode is not more than 90%.

7. The time-of-flight mass spectrometer according to claim 5, wherein the electrode has a plurality of apertures arranged two-dimensionally.

8. The time-of-flight mass spectrometer according to claim 5, wherein the anode is comprised of a metal flat plate.

* * * * *